United States Patent [19]

Kuiper et al.

[11] 4,215,457

[45] Aug. 5, 1980

[54] RAPID HEATING DISPENSER CATHODE IN A HOLDER AND METHOD OF MANUFACTURING THE SAME

[75] Inventors: Adrianus Kuiper; Paulus R. Boelens; Jacob Blanken, all of Eindhoven, Netherlands

[73] Assignee: U.S. Philips Corporation, New York, N.Y.

[21] Appl. No.: 961,433

[22] Filed: Nov. 16, 1978

Related U.S. Application Data

[63] Continuation of Ser. No. 815,288, Jul. 13, 1977, abandoned.

[51] Int. Cl.[2] ..... H01J 9/12

[52] U.S. Cl. ..... 29/25.14; 29/25.15; 29/515

[58] Field of Search ..... 29/25.13, 25.14, 25.15, 29/25.17, 420, 420.5, 505, 515

[56] References Cited

U.S. PATENT DOCUMENTS

| | | | |
|---|---|---|---|
| 3,041,717 | 7/1962 | Brown | 29/505 X |
| 3,169,302 | 2/1965 | Tethal | 29/505 |
| 3,467,879 | 9/1969 | Blatter | 313/346 R |

*Primary Examiner*—Richard B. Lazarus
*Attorney, Agent, or Firm*—Marc D. Schechter

[57] ABSTRACT

By embedding the impregnated and sintered molding of a dispenser cathode in a holder of metal foil of 10 μm to 100 μm thick, such that any gap between the molding and the holder is less than 10 μm a dispenser cathode can be obtained having a long life and/or quick heating properties.

5 Claims, 9 Drawing Figures

Fig. 1
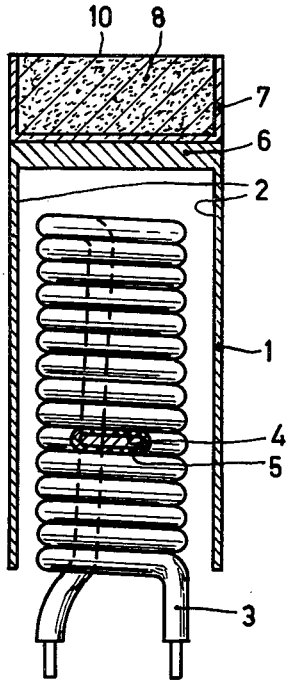
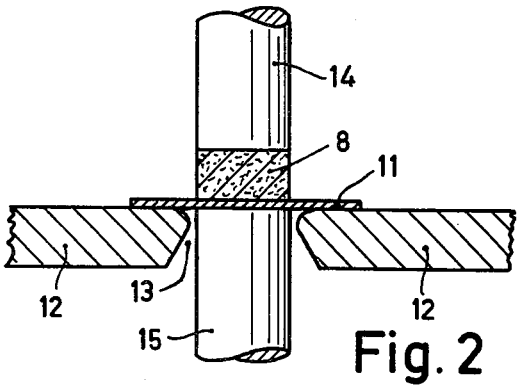
Fig. 2
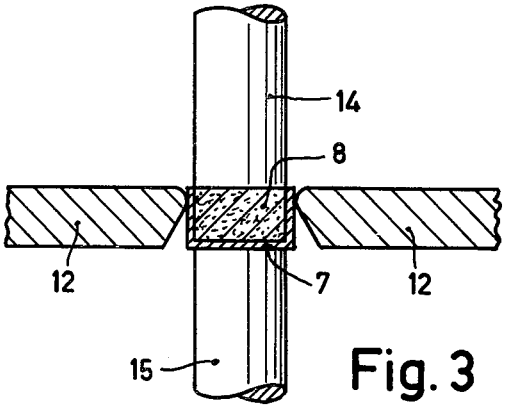
Fig. 3
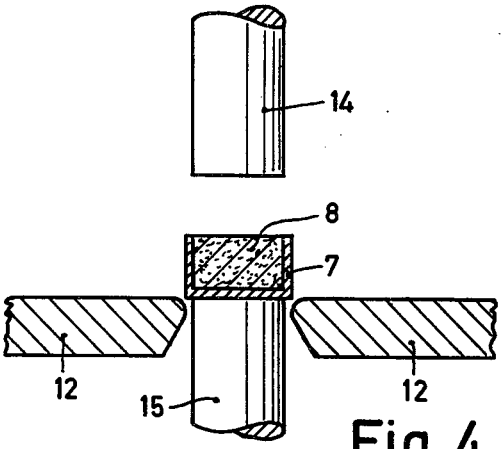
Fig. 4

RAPID HEATING DISPENSER CATHODE IN A HOLDER AND METHOD OF MANUFACTURING THE SAME

This is a continuation, of application Ser. No. 815,288, filed July 13, 1977 and now abandoned.

BACKGROUND OF THE INVENTION

The invention relates to a method of manufacturing a dispenser cathode in which an impregnated and sintered molding is embedded in a holder.

The invention also relates to a dispenser cathode manufactured according to said method.

Such dispenser cathodes are used in electron guns for television display tubes, picture pick-up tubes, travelling wave tubes, klystrons, and the like.

A dispenser cathode, in which a sintered porous tungsten molding which is impregnated with barium aluminate, is compressed in a holder which is clamped to the cathode shank, has been described in U.S. Pat. No. 3,467,879. The molding is laid in the holder in the form of a pill and is compressed by means of a cylindrical die. The holder has been obtained by deep drawing from a molybdenum sheet having a thickness of 100 μm microns. The impregnated and sintered molding is clamped in the holder by deformation of the edge of said holder so that a relatively large gap is present between the molding and the holder.

The use of semiconductors in television cameras and television sets has resulted in the need for rapidly warming-up cathodes. These cathodes are cathodes which emit a sufficient amount of electrons, after less than 5 seconds from switching on, so as to be able to produce a picture on the display screen of the display tube. It is known inter alia from the Philips Product Note 67, Quick Vision CTV picture tube A66-410 X, that the warm-up time ($t_h$) of a cathode is proportional to the ratio of the thermal capacity ($C_{th}$) to the effective heating power ($P_e$) of the heating body of the cathode.

$$t_h \alpha (C_{th}/P_e).$$

In order to be able to shorten the warm-up time of the known cathode described above, an improved cathode should be composed of smaller components than the conventional cathodes so as to reduce its thermal capacity. The drawback of this is, however, that the life of such a cathode is considerably reduced. As a matter of fact, the life is determined inter alia by the ratio between the quantity of impregnate present in the molding which is proportional to the volume of the molding and the quantity of reaction products of the impregnate which leave the molding by evaporation from the surface of the molding. The latter quantity is proportional to the surface area of the molding. It is thus obvious that reducing the size of the molding results in shortening its life.

It has been found that the reduction in life is in fact even larger than follows from the above considerations. This is because the exhaustion of the cathode is diffusionlimited. It has therefore been found that a cathode, of the known, above described construction and of the rapidly warming-up type (less than 5 seconds) which is operated at a voltage 11% above the usual voltage, has a life of only 5000 hours. An advantage of a cathode of the known construction is that the impregnated and sintered molding, prior to being placed in the holder, can be tested for its composition, for example by accurate weighing.

U.S. Pat. No. 3,623,198 describes a method which does not have this advantage. In this application, the material, from which the molding is manufactured, is provided in powdered form and then is pressed by means of a compression tool, into the hollow end face of a cathode shank to form the molding. Subsequently the molding is sintered. This method has been found to be unsatisfactory in manufacturing small cathodes of the rapidly warming-up type, since the deformation of the end face necessary to make it hollow is, for a very small cathode shank, substantially impossible.

SUMMARY OF THE INVENTION

It is therefore an object of the invention to provide a method of manufacturing a dispenser cathode having both a rapid warm-up time and a long life.

According to the invention, in a method of manufacturing a dispenser cathode, aforesaid the holder is tightly formed around the molding in such manner that the width of any gap remaining between the molding and the side wall of the holder is less than 10 μm wide, the holder being manufactured from a metal foil which is from 10 μm to 100 μm thick before forming.

The invention is based on the discovery that the life of a cathode is considerably extended if a holder is a metal foil which is from 10 μm to 100 μm thick which effectively seals the surfaces of the molding which are not to be used for emission. The width of any gap remaining between the holder and the molding should, to accomplish this sealing, be of the same order of magnitude as the pores in the molding, and in any case be smaller than 10 μm. Thus substantially no migration of reaction products takes place from the molding via said gap. This is possible by forming the holder which consists of foil around the compressed and sintered molding.

Since the mass of the holder is also an important factor in obtaining a cathode of the rapidly warming-up type, the holder preferably consists of a metal foil which is from 10 μm to 50 μm thick. With a thickness smaller than 10 μm, the possibility of having pores in the metal foil is too large, and with a thickness exceeding 100 μm the manufacture of the holder around the molding becomes difficult. The metal foil may consist preferably of W, Mo, Ta, Zr or alloys thereof.

Such a cathode is preferably obtained according to the invention in that the molding is placed against a flat metal foil and is pressed through an apertured die by means of a pressing tool, the molding acting as a plunger to draw the metal foil over the molding.

It is also possible to manufacture such a cathode by compressing the impregnated and sintered molding into a partly pre-shaped holder obtained by deep drawing, the dimensions of the molding and the holder being such that the holder is expanded.

Another possibility is to provide the holder in the hot state around the cold molding and then to shrink the holder around the molding by cooling.

BRIEF DESCRIPTION OF THE INVENTION

The invention will now be described in greater detail with reference to the drawings in which FIGS. 1 and 1*a* are diagrammatic partial sectional views of a dispenser cathode according to the invention, FIGS. 2, 3, 4 and 5 show diagrammatically methods of manufacturing a dispenser cathode according to the invention, FIGS. 6 and 7 show a few other possible embodiments of the holders with moldings, and FIG. 8 shows graphically some lifetime measurements.

DESCRIPTION OF THE PREFERRED EMBODIMENTS

Figure 1A:
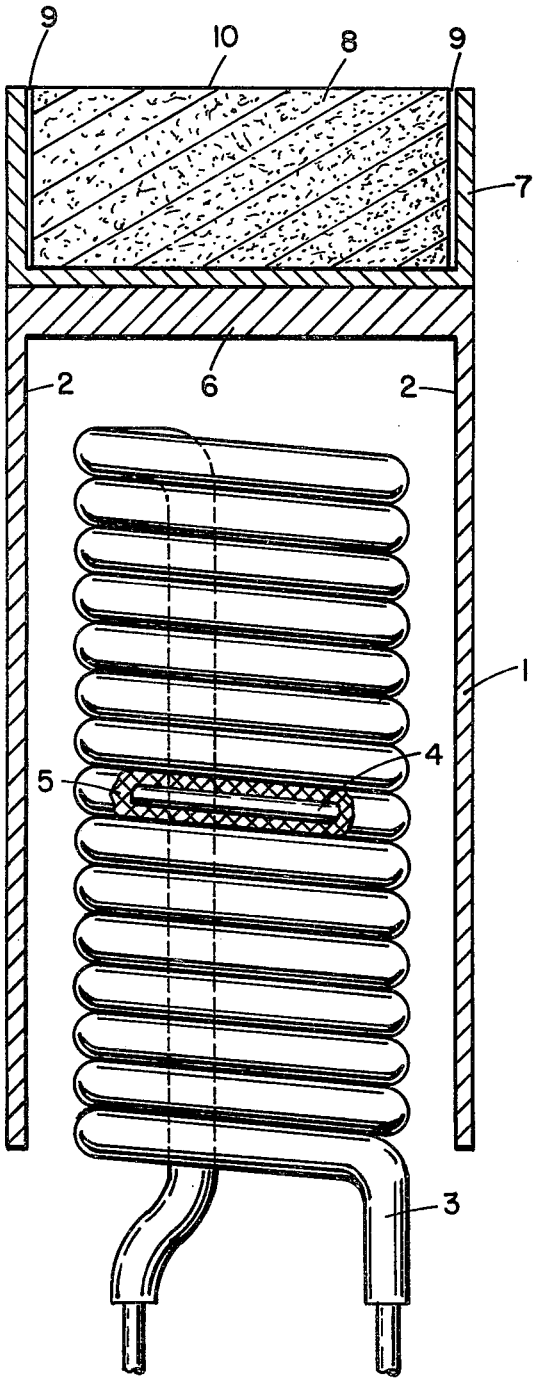

FIGS. 1 and 1*a* are diagrammatic partial sectional views of a dispenser cathode according to the invention. The cathode shank 1 is manufactured from molybdenum foil, 40 μm thick, and is blackened in its internal surface 2 so as to be able to readily absorb the thermal energy irradiated by a heater filament 3. The length of the cathode shank 1 is approximately 2.3 mm and its outer diameter is 1.75 mm. The filament 3 consists of a metal core 4 which is covered with a coating 5 at least the surface of which is black and which readily radiates thermal energy. A 30 μm thick holder 7 is secured to the 100 μm thick end face 6 of the cathode shank by means of resistance welding. The holder 7 has been drawn around a molding 8 impregnated with barium aluminate. This can be seen in FIG. 1*a* where the gap 9 is not drawn to scale. As a result of the small dimensions of the molding 8 (diameter approximately 1.2 mm, height 0.4 mm) and the thin holder 7 (30 μm thick) in combination with the thin blackened cathode shank 1 and the black filament 3, the cathode can reach its required operating temperature in less than 5 seconds after being switched on. An annular gap 9 between the holder 7 and the molding 8 has a width of the same order of magnitude as the dimensions of the pores in the molding, namely less than 10 μm. This can be seen in FIG. 1*a* where the gap 9 is not drawn to scale. As a result of this, evaporation takes place substantially only via the free end surface 10, so that the life of such a cathode is 2 to 3 times longer than that of comparable cathodes manufactured by known methods.

In display tubes for displaying colored pictures, usually three electron beams are generated. In such tubes it is very annoying if the life of one of the cathodes is shorter than that of the other cathodes, because this causes color shifts. It is therefore advantageous to make the life of all the cathodes so long that the electron beams generated by the three cathodes maintain substantially the same intensity during the life of the display tube. This may be done with cathodes according to the invention.

As a result of their relative long life, such dispenser cathodes are also very suitable for use in other beam tubes, such as television camera tubes, e.g. Plumbicon (Trade Mark) tubes, in travelling wave tubes, klystrons and the like. It is not necessary for such tubes to have cathodes of the rapidly warming-up type.

FIGS. 2, 3 and 4 show diagrammatically a method of manufacturing a dispenser cathode according to the invention in three steps. The previously manufactured and impregnated and sintered molding 8 (FIG. 1) is placed on a metal foil 11 of approximately 30 μm thick, the foil being laid over an aperture 13 in a die 12 (FIG. 2). The aperture is adapted to the desired shape of the holder 7 and has a minimum diameter slightly smaller than the diameter of the molding plus two times the thickness of the foil 11. Such a diameter is chosen, not only to give the metal foil a deepdraw operation but also to produce a reduction in wall thickness by 5 μm to 15 μm (so-called tapering), the foil will be resistant to deformation because the metal is work-hardened and to ensure that the gap 9 is small (less than 10 μm). By means of the pressing tool 14 the molding 8 is pressed through the aperture 13 (FIG. 3), said molding serving as a plunger to draw the metal foil 11 into the form of the holder 7. The supporting member 15 also serves to eject the holder with the molding (see FIG. 4).

Figure 5:
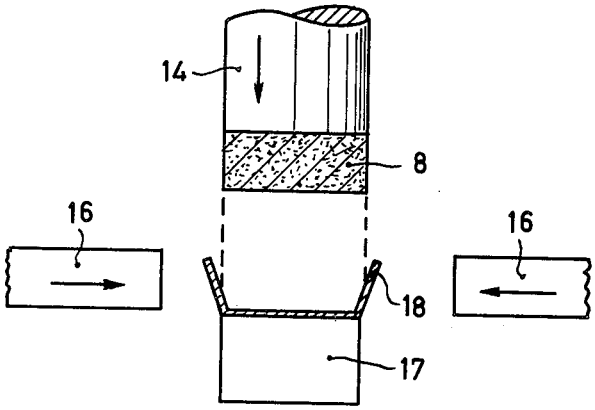

FIG. 5 shows another method of manufacturing a dispenser cathode according to the invention. According to this method, the molding 8 is pressed into a partly preshaped holder 18 which is placed on a supporting block 17. During the pressing operation, pressure members 16 are moved inwardly and pressed against sides of the holder. As a result of this, the holder 18 is expanded by the molding 8, while the wall thickness is reduced and the holder becomes tightly fit around the molding.

Figure 6:
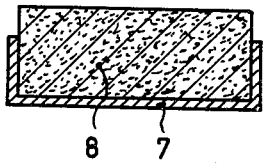
Figure 7:
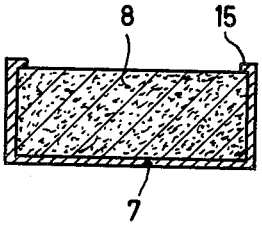

The dimensions of the foil 11 may be chosen so that the molding 8 projects above the holder 7 as is shown in FIG. 6, or that the edge 15 of the holder 7 projects just slightly above the molding 8, as shown in FIG. 7. If the plunger 14 has a smaller diameter than the molding 8, it has been found that as a result of the drawing process said edge 15 projects slightly inwardly.

Figure 8:
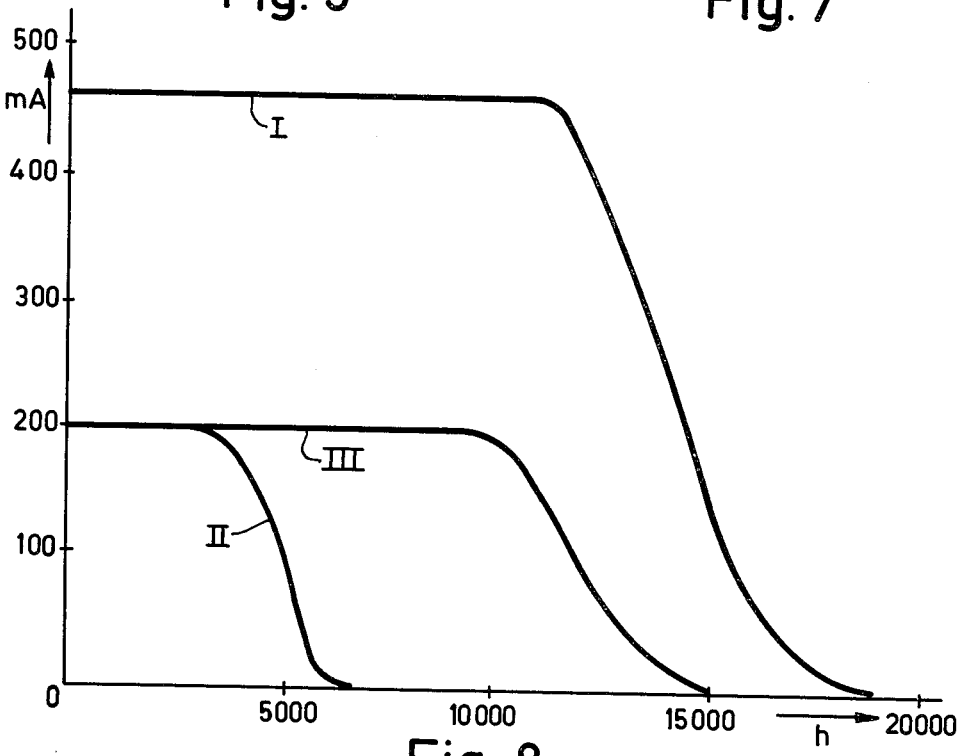

FIG. 8 shows three graphs I to III of measured saturation emission current against time during the life of three cathodes. Graph I relates to a known cathode manufactured by the method as described in the aforementioned U.S. Pat. No. 3,467,879. The diameter of the molding was 1.8 mm and its height was 0.6 mm. The operating temperature was approximately 1317 K and the warm-up time to reach an emission of $0.1 A/cm^2$ was 12 seconds. By making the diameter of the molding 1.2 mm and reducing its height to 0.4 mm, a cathode was obtained, by previously known methods, having a warm-up time of 5 seconds to reach the same current density. A life measurement (graph II) has demonstrated that the life decreases considerably to less than 5000 hours by reducing the molding.

In constrast, by using the invention by giving the holder a thickness between 10 μm and 100 μm and making the gap between the holder and the molding minimum (smaller than 10 μm), a cathode is obtained having a short warm-up time (less than 5 seconds) and a long life (graph III). All the life measurements were performed with a heater voltage which was 11% higher than the usual heater voltage of 6.3 volts.

In cathodes in which the starting material is an impregnated and sintered molding it is thus favorable according to the invention to provide a holder of thin metal foil around said molding.

What is claimed is:

1. A method of manufacturing a dispenser cathode in which a porous sintered molding of refractory metal impregnated with electron emissive material in the pores thereof is embedded in a holder, comprising the steps of:

placing the molding in contact with a flat metal foil having a thickness of 10 to 100 microns; and mechanically forming the metal foil into a holder surrounding the sides and the rear of the molding while leaving the front surface of the molding exposed by pressing the molding through an apertured die by means of a pressing tool, the molding acting as a plunger to draw the metal foil over the molding, such that any gap between the molding and the sidewall of the holder is less than 10 microns wide.

2. A method of manufacturing a dispenser cathode, in which an electron emissive molding is embedded in a holder, comprising the steps of:

placing the molding against a flat metal foil; and pressing the molding through an aperture in a die, the aperture having dimensions slightly smaller than those of the molding plus two times the thickness of the foil, the molding acting as a plunger to draw the metal foil over the molding;

whereby the holder is tightly formed around the molding such that any gap which remains between the holder and the molding is less than 10 microns wide, and such that the holder effectively seals the surfaces of the molding which are not to be used for electron emission, thereby prolonging the useful life of the cathode.

3. A method of manufacturing a dispenser cathode, according to claim 2, wherein the metal foil is from 10 microns to 100 microns thick.

4. A method of manufacturing a dispenser cathode according to claim 3, wherein the molding consists of tungsten impregnated with barium aluminate and wherein the metal foil consists of one of the group of tungsten, molybdenum, tantalum, zirconium or alloys thereof.

5. A method of manufacturing a dispenser cathode according to claim 4, wherein the diameter of the molding is approximately 1.2 mm, the height of the molding is approximately 0.4 mm, and the holder is approximately 30 microns thick, whereby the cathode will have a relatively rapid warm-up time.

* * * * *